US005496159A

United States Patent [19]

Devore

[11] Patent Number: 5,496,159

[45] Date of Patent: Mar. 5, 1996

[54] ROTARY DISPLACEMENT PUMP HAVING A SEPARABLE MEMBER THAT CONTROLS THE FLUID FLOWPATH

[75] Inventor: Ronald D. Devore, Santa Clara, Calif.

[73] Assignee: Xerox Corporation, Stamford, Conn.

[21] Appl. No.: 216,214

[22] Filed: Mar. 22, 1994

[51] Int. Cl.[6] ..... F01C 21/00

[52] U.S. Cl. ..... 418/178

[58] Field of Search ..... 418/178, 259, 418/268

[56] References Cited

U.S. PATENT DOCUMENTS

| | | | |
|---|---|---|---|
| 2,738,775 | 3/1956 | Symsen | 418/178 X |
| 3,873,231 | 3/1975 | Callahan | 415/195 |
| 4,229,147 | 10/1980 | Linder et al. | 417/283 |
| 4,640,125 | 2/1987 | Carpenter | 418/178 X |
| 4,770,616 | 9/1988 | Kahrs | 418/26 |
| 5,096,390 | 3/1992 | Sevrain et al. | 417/420 |
| 5,144,802 | 9/1992 | Ruzic | 60/484 |
| 5,160,252 | 11/1992 | Edwards | 418/1 |

OTHER PUBLICATIONS

Little, Jr., C. W. Rotary Pumps. In: Karassik, I. J., Krutzsch, W. C., Fraser, J. P. and Messina, J. P., Editors, Pump Handbook. New Jersey; McGraw–Hill Book Company, pp. 3–70 through 3–99.

*Primary Examiner*—Richard E. Gluck

[57] ABSTRACT

A rotary displacement pump including an external member or housing having inlet and outlet channels and a cavity. The pump also includes an internal member or housing having a shell with an inlet opening and an outlet opening therein, the shell being received in the cavity so that the inlet opening and the outlet opening is aligned with the inlet and outlet channels. Further included is a fluid drive member received within the shell for moving fluid from the inlet to outlet channels. The inlet opening and the outlet opening in the shell define fluid flow transition regions.

4 Claims, 6 Drawing Sheets

ROTARY DISPLACEMENT PUMP HAVING A SEPARABLE MEMBER THAT CONTROLS THE FLUID FLOWPATH

BACKGROUND OF THE INVENTION

This invention relates to rotary displacement pumps, and more particularly, to a rotary displacement pump having a separable member that controls transitional regions and thereby the fluid flowpath.

Many types of rotary displacement pumps have been used for various purposes. A description of the design and operation of rotary displacement pumps can be found in the McGRAW-HILL book titled "Pump Handbook" edited by Karassik, Krutzsch, Fraser, and Messina, on pages 3–70 through 3–99, section 3.4 titled "Rotary Pumps" by C. W. Little, Jr., which is hereby incorporated by reference. Furthermore, the following US-A Patents can be referenced for more teachings on the design and uses of rotary pumps: U.S. Pat. Nos. 5,160,252 to Edwards; 5,144,802 to Ruzie; 5,096,390 to Sevrain et al.; 4,770,616 to Kahrs; 4,229,147 to Linder et al.; and, 3,873,231 to Callahan.

In general, a rotary displacement pump can be loosely defined as one in which the main pumping action is caused by relative movement between rotating elements and stationary elements. One popular type of rotary pump is the vane and rotor pump. Although this type of pump shall be described herein, it should be noted that the present invention is applicable to other designs and is not limited to rigid vane rotary pumps. For instance, other applicable pumps can include an external gear pump, an internal gear pump, a screw and wheel pump, a multiple rotor screw pump, an external circumferential piston pump, an internal circumferential piston pump, various lobe pumps, a single screw pump, external vane-in-body pump, a flexible vane pump, a flexible liner pump, and a flexible tube pump.

Transitional inlet and outlet regions into the fluid flowpath of a pump are critically important in almost all pump applications as described in the "Pump Handbook." These transitional regions are often recessed ports which change the internal geometry of the flowpath within the pump at the areas where fluid enters the flowpath and exits the flowpath. Properly designed transitional regions are important primarily for two reasons. First, without proper port design, unfavorable flow inlet and outlet conditions will develop resulting in inlet and outlet losses that lower the efficiency of the pump. Secondly, without properly transitional regions, there will be sharp corners in the flow path geometry causing rapid flow direction changes. This greatly increases the likelihood of cavitation especially at higher pump speeds or when the fluid medium is of low viscosity. Cavitation is vapor formation in the form of very tiny bubbles at any area in the flow path where the local pressure approaches or drops below the vapor pressure of the fluid medium.

Cavitation adversely affects pump performance in three ways. Since this type of pump is a fixed displacement device, if, for example, only half of the actual fluid volume swept from the inlet chamber transitional region is vapor, then only half the normal capacity liquid volume is available at the outlet transitional region chamber, and the pump capacity is reduced accordingly. Secondly, physical damage to internal pump components and surfaces is caused by the collapse of cavitation vapor bubbles. This is known as cavitation erosion or pitting. Finally, cavitation often results in noisy and rough operation caused by the formation and collapse of vapor bubbles. All three have a negative effect on pump efficiency and/or component life.

Another desirable attribute which can be used in designing a rotary displacement pump is that of a substantial colinear alignment of the inlet and outlet transitional regions and corresponding inlet and outlet fittings. Colinear alignment of the inlet and outlet fittings makes plumbing connections in many applications greatly simplified. A straight section of fluid plumbing, for instance, can be broken and the pump inserted directly in the line with no further modification. Not only does the straight through flow offer simple system connections, it also has additional system benefits. For instance, some systems rely on rapid and efficient drain back of fluid through the system, and specifically the pump. Any configuration other than the straight through flow configuration would trap significantly more fluid after drain back, therefore, the colinear inlet and outlet fitting configuration is very important to pump performance in many applications.

As noted above, transitional region design and system inlet and outlet transitional regions aligned substantially in a colinear manner are two features that are critical to pump performance, but can be difficult and costly to manufacture. Specifically, when the straight through inlet and outlet fitting alignment is combined with the necessity for transitional regions provided by recessed inlet and outlet ports, severe tooling difficulties are encountered. These difficulties are the reason that pumps of this configuration are either made from processes such as metal casting, made without recessed port designs, or made with inlet and outlet fittings which are not colinear. As will be seen with reference to FIGS. 1, 2*a*, and 2*b*, each of these possibilities are generally inferior to the proposed invention.

For the purpose of illustration, FIG. 1 shows the components and critical flow path elements of a standard rotary vane pump 10 of the prior art. Rotary pump 10 includes a body 11, transitional inlet region 12, transitional outlet region 14, rotor 16, vanes 18, inlet fitting 20 outlet fitting 22 and internal flow area 24. Rotor 16 is disposed in an eccentric relationship to the internal casing of body 11.

As rotor 16 and vanes 18 rotate inside the stationary body 11, volumes of fluid are transferred through a channel and inlet port in inlet fitting 20 into transitional inlet region 12. Propelled by rotor 16, the fluid then flows through internal flow area 24 to transitional outlet region 14 then out of pump 10 through an outlet port and channel in outlet fitting 22. Note that the areas defining transitional inlet region 12 and transitional outlet region 14 are recesses in the substantially circular interior of pump 10. As discussed above, the shapes of these transitional regions are critical to pump performance. Also note, that the flow direction at inlet fitting 20 is substantially the same as at the outlet fitting 22 making the pump colinear.

Pump 10 of FIG. 1 can be adequate for some applications, however, it is inflexible in design and expensive to manufacture. The pump as shown requires a casting method to be manufacturable, and has the typical configuration of a body housing all the pumping components along with a separable cover (not shown). The transitional regions of this device are designed to a meet certain flowpath specifications which may be determined by the fluid it will be pumping or the velocity the fluid will be traveling through the pump. A redesign would be required to change the flow path specifications to meet requirements for a fluid with different characteristics or for a different fluid velocity. In addition, manufacturing this device using a metal casting method could be very expensive. Clearly, a plastic injection molding process for manufacturing the device would be preferred due to the diverse range of materials to choose from and the low cost of manufacturing using injection molding. However, due to the transitional regions being integral with the inlet and outlet ports, manufacturing this device using injection molding is difficult. Furthermore, a design which could be easily changed to permit the use of a variety of fluids and fluid velocities would be more desirable.

FIGS. 2*a* and 2*b* show two popular examples of changing pump geometry to enable manufacturing by injection molding and therefore less expensive pump designs than that of FIG. 1. Note that both pumps include a main body housing the pumping elements with a cover (not shown). Pump 26 of FIG. 2*a* has a colinear design which is desirable in many applications. However, pump 26 does not provide for varied design in either transitional inlet region 28 or transitional outlet region 30. The transitional regions of pump 26 are simply ports, with no specific design or shape to increase pump efficiency. Therefore, pump 26 is only a marginal design because the transitional regions cannot be shaped to enhance pump efficiency.

Pump 34 of FIG. 2*b* is another example of a pump which can be manufactured using injection molding. Pump 34 of FIG. 2*b* has a limited ability to change the design of transitional inlet region 36 and transitional outlet region 38. However, the inlet and outlet fittings to the pump are not colinear making this pump inappropriate for certain applications.

The performance losses and hazards of improperly designed transitional regions are well documented. The system installation and system drain back benefits of having colinear inlet and outlet fittings can not be obtained by any other configuration. Therefore, it is recognized that a design for a rotary displacement pump allowing flexible design of transitional regions which is inexpensive to manufacture would be desirable. In addition, a pump having transitional regions on a member which is separable and easily modified for change in fluid characteristics or fluid velocities would also be desirable. Furthermore, an additional advantage would be realized if the pump could be manufactured using the plastic injection molding process.

SUMMARY OF THE INVENTION

In accordance with the present invention, provided is a rotary displacement pump including an external member having inlet and outlet channels and a cavity. Also included is an internal member having a shell with an inlet opening and an outlet opening therein, the shell being received in the cavity so that the inlet opening and the outlet opening is aligned with the inlet and outlet channels. Further included is a fluid drive member received within the shell for moving fluid from the inlet to outlet channels.

DETAILED DESCRIPTION OF THE INVENTION

Figure 1:
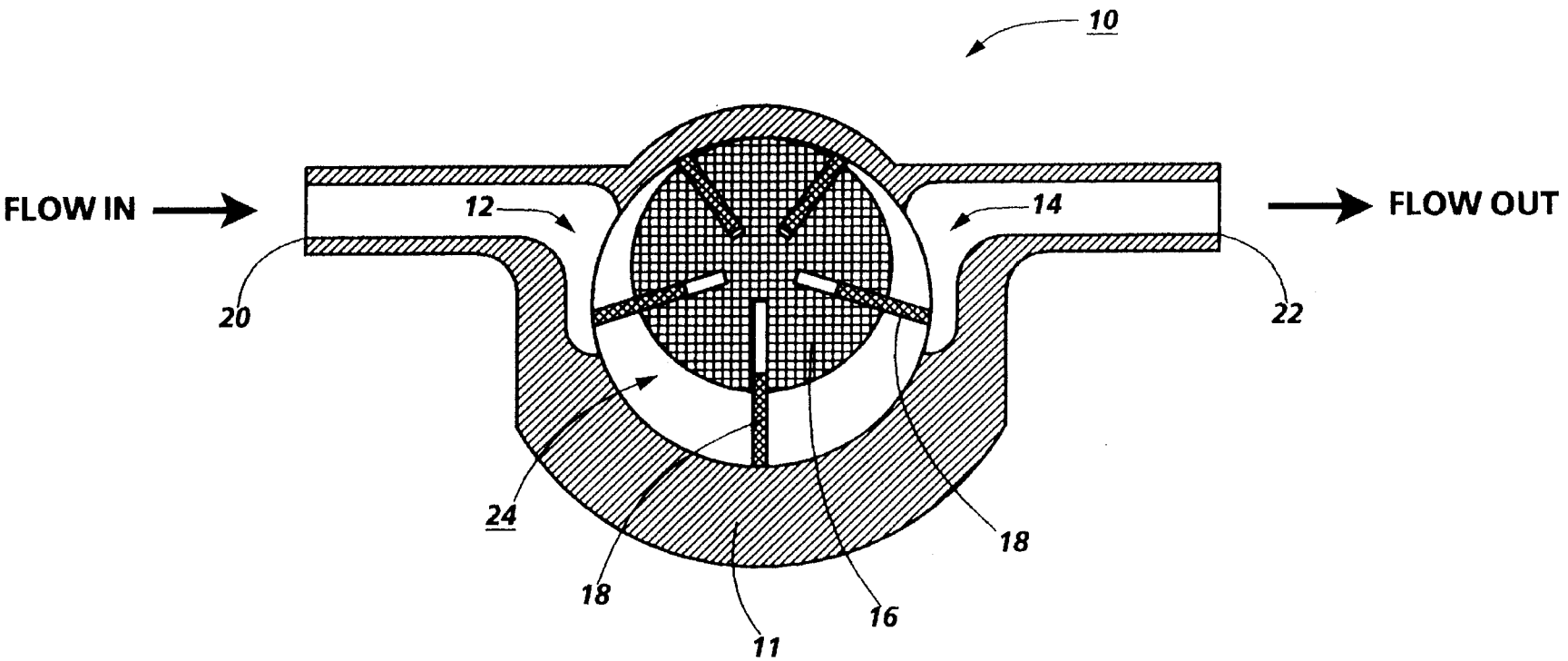
Fig. 1 (Prior Art)
FIG. 1 is a sectional view showing the basic components of a rigid vane rotary displacement pump of the prior art.
Figure 2A:
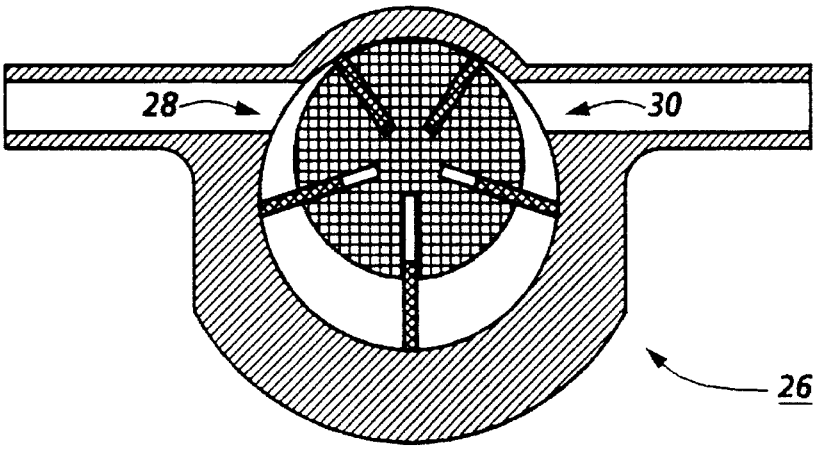
Fig.2a (Prior Art)
FIG. 2*a* is a sectional view depicting a colinear pump design of the prior art that is suitable for injection molding.
Figure 2B:
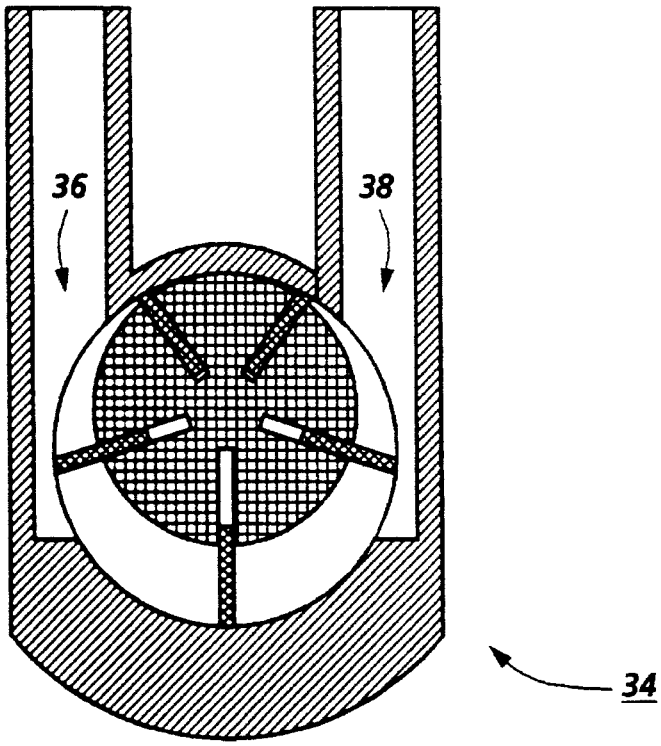
Fig.2b (Prior Art)
FIG. 2*b* is a sectional view a non-colinear pump design of the prior art that is suitable for injection molding.

The pumps of the prior art discussed thus far with reference to FIGS. 1 and 2 include a body that contains all of the necessary flowpath elements and a cover that seals the fluid flowpath within the body. However, the present invention provides a pump design which divides the necessary flowpath elements between two members, referred to herein as the internal housing and the external housing. As will be seen, the division of the flowpath elements provides a means for designing variable flowpaths by changing the designs of the transitional regions resident on the separable internal housing member. Therefore, the pump design of the present invention can be used for various fluids and flow conditions by changing only one element.

Figure 3:
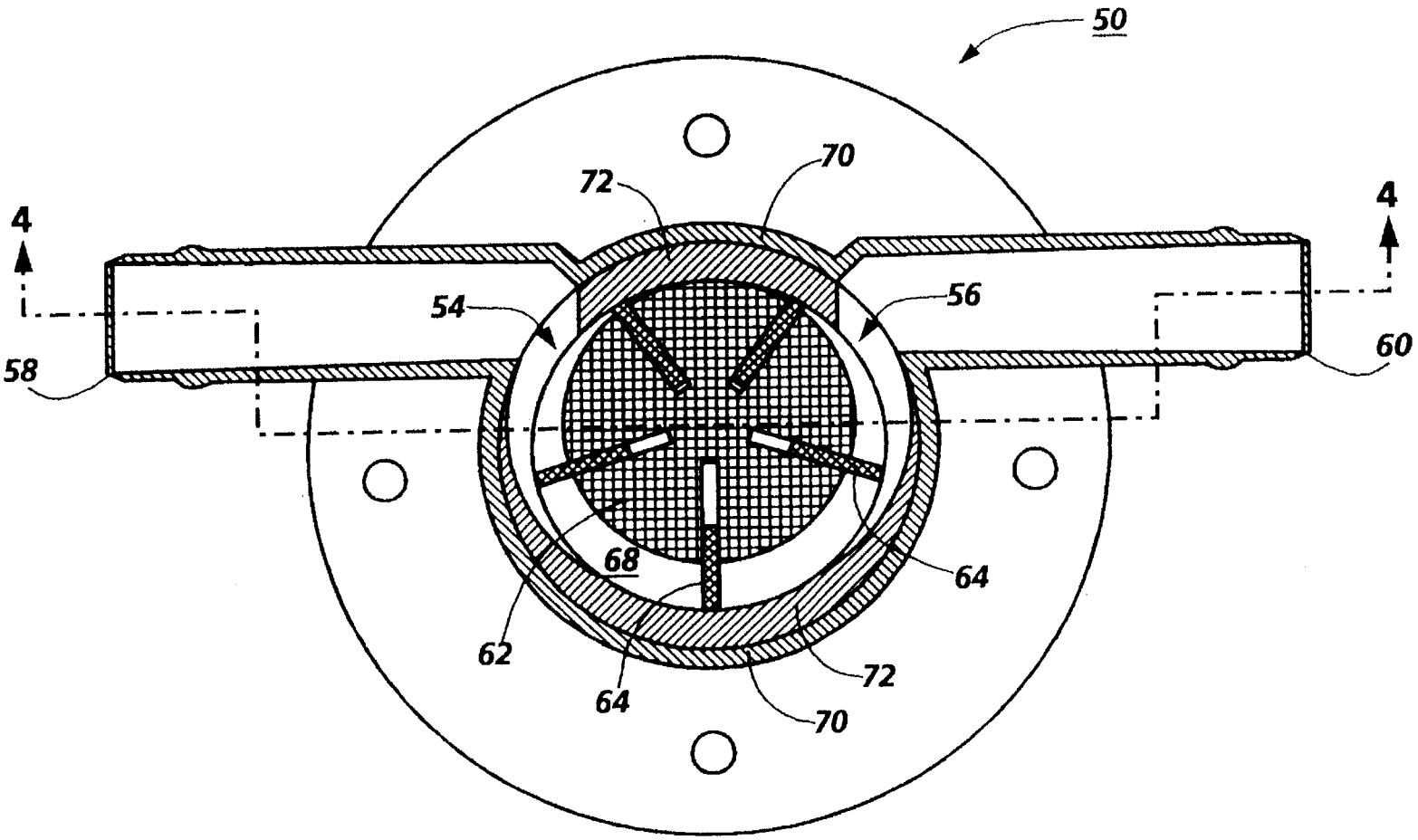
FIG. 3 is a sectional view depicting the pump of the present invention.

FIG. 3 shows a cross section of assembled pump 50 in accordance with the present invention. Pump 50 has transitional inlet region 54 and transitional outlet region 56 corresponding to inlet fitting 58 and outlet fitting 60 respectively. Inlet fitting 58 has a channel and port for allowing fluid to pass though and into transitional inlet region 54. Accordingly, outlet fitting 60 has a channel and port for allowing fluid to pass from transitional outlet region 56 out through fitting 60.

Also included in pump 50 is rotor 62 and vanes 64 acting as a fluid drive member. As shown, fluid medium is moved by vanes 64 from transitional inlet region 54 through internal flow area 68 and out through transitional outlet region 56. The body of pump 50 is comprised of external housing 70 and internal housing 72, where internal housing 72 is a separable member which can be customized to control fluid flow though the design of transitional inlet region 54 and transitional outlet region 56.

Figure 4:
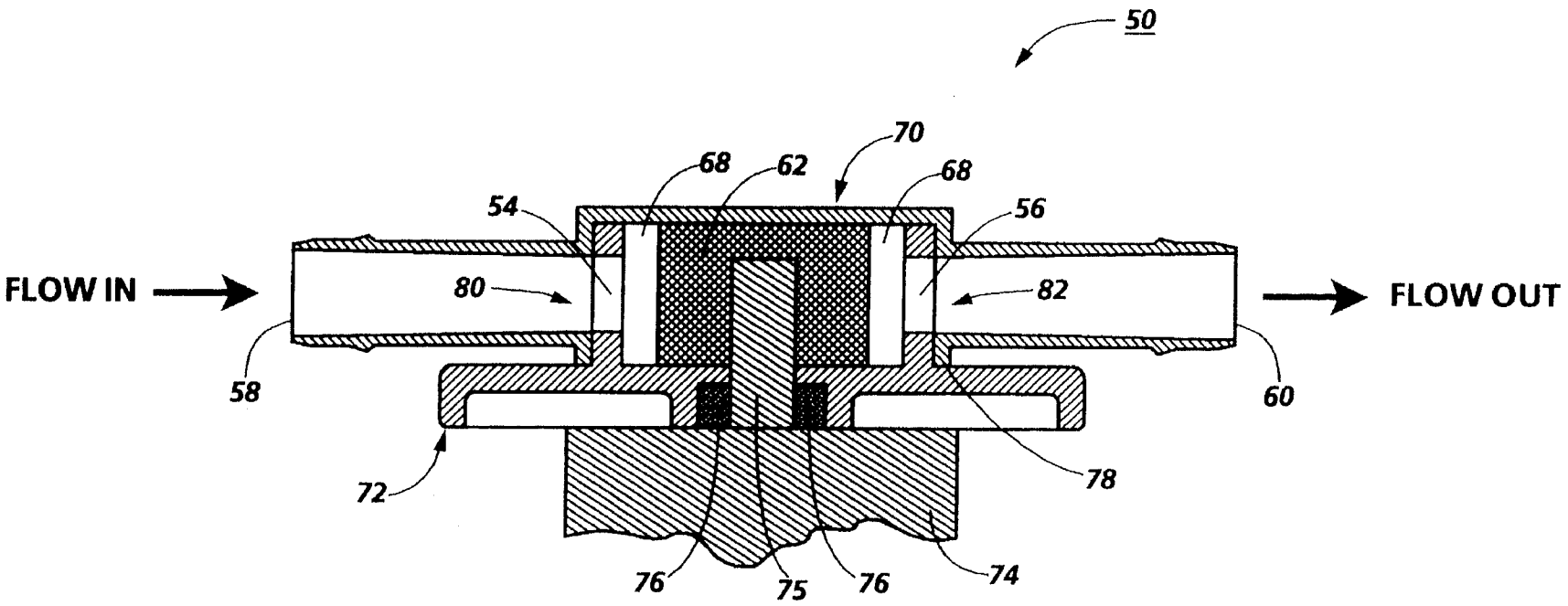
FIG. 4 is a cross sectional view taken substantially across line 4—4 of the pump shown in FIG. 3.

FIG. 4 includes motor 74 for driving rotor 62. Motor 74 has drive shaft 75 which is inserted into rotor 62 causing rotor 62 to rotate and thus, move fluid through pump 50. Shaft 75 of motor 74 is sealed within internal housing 72 by shaft seals 76. In this cross sectional view, the movement of a liquid can be followed from the "flow in" at inlet fitting 58 through to the outlet fitting 60 in the "flow out" direction. Although pump 50 has been described as a unidirectional pump, it can be appreciated that pump 50 could also be used as a bidirectional pump when the design of the transitional inlet region and the transitional outlet region are substantially the same.

Figure 5:
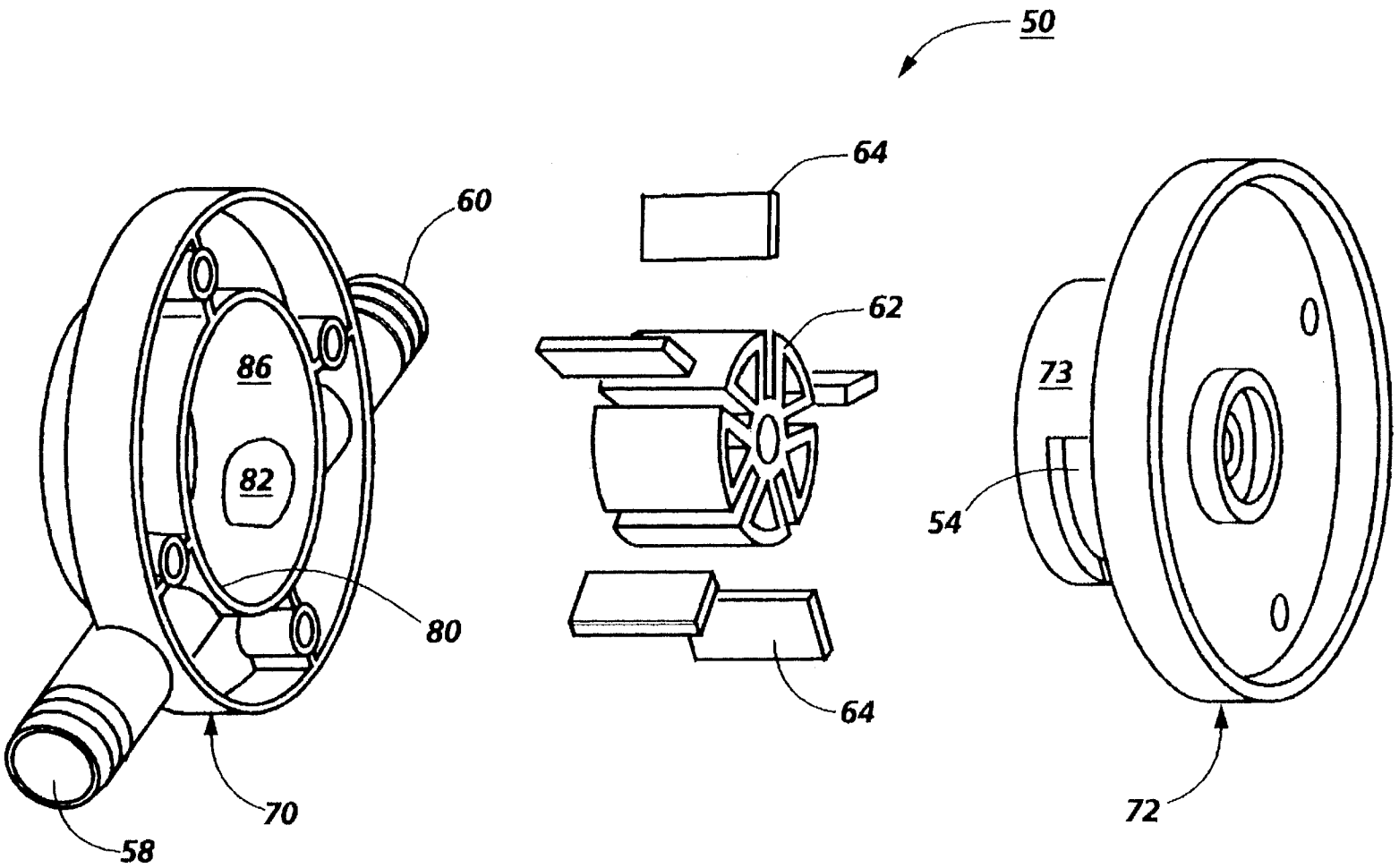
FIG. 5 is an exploded view of the pump of FIG. 3.
Figure 6:
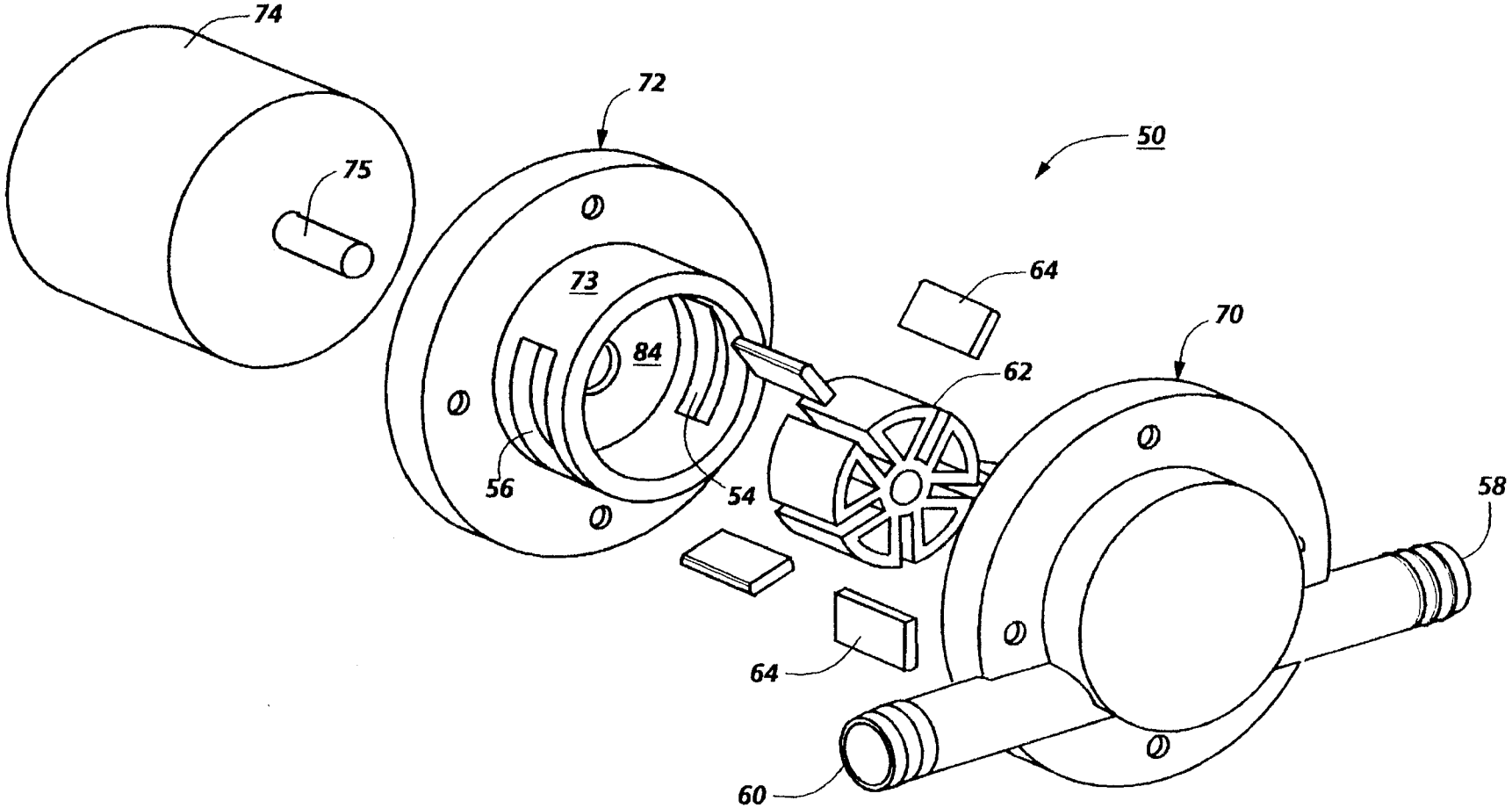
FIG. 6 is an exploded view, taken in the opposite direction, of the pump of FIG. 3 further including a motor.

As shown in FIGS. 5 and 6, external housing 70 includes inlet fitting 58, outlet fitting 60 with corresponding port 80 and port 82. Internal housing 72 includes transitional inlet region 54 and transitional outlet region 56 made within shell 73 of internal housing 72. When assembled, port 80 (FIG. 4) of external housing 70 is aligned with transitional inlet region 54 of internal housing 72. In a similar manner, port 82 of external housing 70 is aligned with transitional outlet region 54 of internal housing 72. The alignment of ports and transitional regions allows the fluid medium to flow through the pump.

Also when assembled, rotor 62 with vanes 64 slideably mounted in place is disposed in an eccentric relationship into space 84 of shell 73. Shell 73 of internal housing 72 is then slid into cavity 86 of external housing 70 to complete the assembly. An interference seal between the wall of cavity 86 and the surface of shell 73, along with fastening devices such as screws, are used to hold internal housing 72 in place within external housing 70 to prevent fluid leaks. An o-ring (not shown) is also used in between internal housing 72 and external housing 70 to prevent leaks.

As can be appreciated, the simplicity of this two member pump design enables pump 50 to be manufactured using a plastic injection molding process. As previously mentioned, it is difficult to make a pump having a straight through flow path and transitional regions with injection molding. However, with the design of the present invention, the internal housing having the transitional regions can be easily tooled for injection molding.

It is important to note that with the transitional regions formed as part of separable internal housing 72, the operation of pump 50 can changed to accommodate different design parameters and specifications by simply redesigning and replacing only the internal housing. The splitting of the fluid channels at the transitional regions leads to a very flexible design scheme and a tremendous cost savings over the prior art pump configurations.

Although the pump has been described as a colinear device, it can be appreciated that the design of a pump having a separable member with transitional regions to control the fluid flow path could also be designed with transitional regions having various sizes, shapes and inlet to outlet angles.

It should also be noted that neither the total part count or the difficulty of mechanical assembly has increased over prior art designs by having a design with pumping elements in separable members. The standard body and cover design is two pieces mechanically fastened together with fastening devices and an o-ring to seal the flow path. The present invention has the same part count as the standard body with cover pump of the prior art, and is mechanically fastened in a similar manner.

It should be noted that although rigid vanes have been disclosed in this design, flexible vanes could also be used. With a flexible impeller design, the design of the transitional regions are less critical compared to a rigid vane pump, however control of the fluid flow is still important. Thus, the design of the transitional regions is still a consideration.

Furthermore, as discussed in the background, although a rotary vane type of pump is described herein, it can be appreciated that the present invention is applicable to any rotary displacement pump.

While the invention has been described with reference to the structures disclosed, it is not confined to the details set forth, but is intended to cover such modifications or changes as may come within the scope of the following claims:

I claim:

1. A rotary displacement pump, comprising:

an external member integrally configured to define a cavity therein, the external member further having colinear inlet and outlet channels;

an internal member having a flange and an integrally attached shell, the shell having an inlet opening and an outlet opening therein, with the flange externally fitted against the external member in sealing attachment to together define a sealed pump housing, and with said shell being positioned in said cavity of the external member to align said inlet opening and said outlet opening with said colinear inlet and outlet channels; and a fluid drive member received within the pump housing, the fluid drive member being rotatably driven by a motor to move fluid from said inlet to outlet channels.

2. A rotary displacement pump according to claim 1, wherein said inlet opening and said outlet opening in said shell define fluid flow transition regions.

3. A rotary displacement pump according to claim 1, wherein said fluid drive member is a rotor with vanes.

4. A rotary displacement pump according to claim 3, wherein said vanes are rigid and slideably mounted in said rotor.

* * * * *